US008114325B2

(12) United States Patent
Armantrout et al.

(10) Patent No.: US 8,114,325 B2
(45) **Date of Patent: *Feb. 14, 2012**

(54) PROCESS FOR FORMING UNIFORMLY DISTRIBUTED MATERIAL

(75) Inventors: Jack Eugene Armantrout, Richmond, VA (US); Robert Anthony Marin, Midlothian, VA (US); Larry R. Marshall, Chesterfield, VA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/220,631

(22) Filed: Jul. 25, 2008

(65) Prior Publication Data

US 2008/0284055 A1 Nov. 20, 2008

Related U.S. Application Data

(63) Continuation of application No. 10/818,428, filed on Apr. 5, 2004, now abandoned.

(60) Provisional application No. 60/460,182, filed on Apr. 3, 2003.

(51) Int. Cl.
*D01D 5/11* (2006.01)
*D01D 5/18* (2006.01)

(52) U.S. Cl. ..... 264/205; 264/211.1; 264/13; 264/14; 264/465

(58) Field of Classification Search ..... None
See application file for complete search history.

(56) References Cited

U.S. PATENT DOCUMENTS

| | | | | |
|---|---|---|---|---|
| 3,081,519 | A | 3/1963 | Blades et al. | |
| 3,169,899 | A | 2/1965 | Steuber | |
| 3,227,784 | A | 1/1966 | Blades et al. | |
| 3,413,185 | A | 11/1968 | Davis et al. | |
| 3,600,483 | A * | 8/1971 | Davis et al. | 264/53 |
| 3,851,023 | A * | 11/1974 | Brethauer et al. | 264/441 |
| 3,860,369 | A | 1/1975 | Brethauer et al. | |
| 3,870,567 | A * | 3/1975 | Palmer et al. | 156/167 |
| 4,192,838 | A * | 3/1980 | Keith et al. | 264/10 |
| 4,336,214 | A * | 6/1982 | Reinehr et al. | 264/49 |
| 5,607,636 | A * | 3/1997 | Ito et al. | 264/205 |
| 5,788,993 | A | 8/1998 | Bryner et al. | |

FOREIGN PATENT DOCUMENTS

| | | |
|---|---|---|
| GB | 2 063 321 A | 6/1981 |
| WO | WO 01/29295 A1 | 4/2001 |

* cited by examiner

*Primary Examiner* — Monica A Huson

(57) ABSTRACT

A fluidized mixture is issued from a nozzle comprising a fan jet at the outlet, causing the mixture to spread as it is issued. The issued material is collected on a moving collection surface located a distance of between 0.25 and 13 cm from the outlet of the nozzle, prior to the onset of large scale turbulence in the fluid jet. The resulting product has good basis weight uniformity.

21 Claims, 2 Drawing Sheets

PROCESS FOR FORMING UNIFORMLY DISTRIBUTED MATERIAL

RELATED APPLICATION

The present application is a continuation of application Ser. No. 10/818,428 filed Apr. 5, 2004 now abandoned

FIELD OF THE INVENTION

The present invention relates to the field of collecting a material issued by a jet in uniformly distributed form. The invention also relates to the field of flash spinning plexifilamentary film-fibril strand material.

BACKGROUND OF THE INVENTION

Manufacturing processes in which a material is formed by propelling a fluid composition from a nozzle by way of a fluid jet upon which the material solidifies into a desired form are known in the art. For example, spray nozzles are used for spraying liquid paints which can contain pigments, binders, paint additives and solvents, the solvents of which flash or evaporate after the paint is applied to a surface leaving dry paint. Processes for producing fine particles are known in which a mist of a solution is propelled from an atomizing nozzle upon which the solvent flashes or evaporates leaving the dry particles. While these processes are capable of forming fine, uniform particles, there is no existing process for collecting the particles in a manner that preserves the uniformity of the newly issued particles, owing to the extremely high rates at which they are propelled.

Flash spinning processes involve passing a fiber-forming substance in solution with a volatile fluid, referred to herein as a "spin agent," from a high temperature, high pressure environment into a lower temperature, lower pressure environment, causing the spin agent to be flashed or vaporized, and producing materials such as fibers, fibrils, foams or plexifilamentary film-fibril strands or webs. The temperature at which the material is spun is above the atmospheric boiling point of the spin agent so that the spin agent flashes upon issuing from the nozzle, causing the polymer to solidify into fibers, foams or film-fibril strands. However, the web layers formed by these conventional flash spinning processes are not entirely uniform.

SUMMARY OF THE INVENTION

The present invention is directed to a process comprising the steps of supplying a fluidized mixture having at least two components to at least one nozzle comprising an orifice opening into a fan jet; issuing the fluidized mixture from the fan jet to form an issued material; vaporizing or expanding at least one component of the issued material to form a fluid jet; transporting the remaining component(s) of the issued material away from the nozzle with the fluid jet; and collecting the remaining component(s) of the issued material on a moving collection surface located at a distance of about 0.25 cm to about 13 cm from the nozzle.

In another embodiment, the present invention is directed to a process comprising flash spinning a polymer solution through a nozzle having a spin orifice opening into a fan jet to form a fluid jet containing plexifilamentary film-fibril strand material and collecting the plexifilamentary film-fibril strand material on a moving collection surface located at a distance of about 0.25 cm to about 13 cm from the nozzle.

Definitions

The terms "nonwoven sheet," "noinwoven" and "sheet," are used herein interchangeably to refer to nonwoven sheet.

The terms "spin agent" is used herein to refer to a volatile fluid in a polymeric solution capable of being flash spun.

The terms "jet" and "fluid jet" are used herein interchangeably to refer to an aerodynamic moving stream of fluid including gas, air or steam. The terms "carrying jet" and "material-carrying jet" are used herein interchangeably to refer to a fluid jet transporting material in its flow.

The terms "plexifilamentary film-fibril strand material," "plexifilamentary film-fibril web," and "flash spun web" are used herein interchangeably to refer to the plexifilamentary film-fibril web material that is formed during a flash spinning process upon the flashing of the spin agent.

The term "machine direction" (MD) is used herein to refer to the direction of movement of a moving collection surface. The "cross direction" (CD) is the direction perpendicular to the machine direction.

BRIEF DESCRIPTION OF THE DRAWINGS

The accompanying drawings, which are incorporated in and constitute a part of this specification, illustrate the presently preferred embodiments of the invention and, together with the description, serve to explain the principles of the invention.

DETAILED DESCRIPTION OF THE INVENTION

Figure 1:
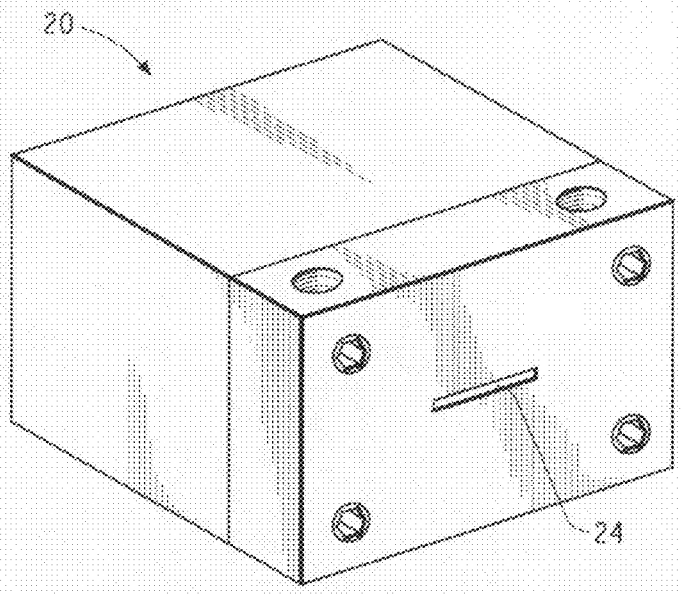
FIG. 1 is a perspective drawing of a spin pack in accordance with the invention.

Reference will now be made in detail to the presently preferred embodiments of the invention, examples of which are illustrated in the accompanying drawings. Throughout the drawings, like reference characters are used to designate like elements.

Conventional flash spinning processes for forming web layers of plexifilamentary film-fibril strand material are disclosed in U.S. Pat. No. 3,081,519 (Blades et al.), U.S. Pat. No. 3,169,899 (Steuber), U.S. Pat. No. 3,227,784 (Blades et al.), U.S. Pat. No. 3,851,023 (Brethauer et al.), the contents of which are hereby incorporated by reference. One difficulty with conventional flash spinning processes is in attempting to collect the web layers in a perfectly spread state, which would result in a product with excellent uniformity of thickness and basis weight.

It would be desirable to have a flash spinning process which would result in a plexifilamentary film-fibril sheet having improved uniformity of web distribution and of basis weight.

In the process of the present invention, a material is issued from a nozzle directed at a moving collection surface, e.g., a moving belt or a rotating drum, located a distance of between about 0.25 cm and about 13 cm from the nozzle. The nozzle is encased in a spin pack which comprises at least one nozzle surrounded by a spin pack body. Multiple nozzles can be present in a single spin pack. Multiple spin packs can be employed simultaneously, directed at the same moving collection surface.

Several types of materials can be supplied to the spin pack and issued from the nozzles therein. The material is supplied in the form of a fluidized mixture. By "fluidized mixture" is meant a composition in the liquid state or any fluid at greater than its critical pressure, the mixture comprising at least two components. The fluidized mixture can be a homogeneous fluid composition, such as a solution of a solute in a solvent, a heterogeneous fluid composition, such as a mixture of two fluids or a dispersion of droplets of one fluid in another fluid, or a fluid mixture in compressed vapor phase. A fluidized mixture suitable for use in the process of the invention can comprise a solution of a polymer in a spin agent. The fluidized mixture can also comprise a dispersion or suspension of solid particles in a fluid, or a mixture of solid material in a fluid.

The process of the invention can be utilized to make paper by supplying a fluidized mixture of pulp and water to the spin pack and supplying sufficient pressure so that the mixture is propelled from the nozzles to a collector located a certain distance from the spin pack.

In another embodiment of the present invention, a fluidized mixture of a solid material, such as pulp, and a fluid, such as water, is supplied to the spin pack at a temperature above the boiling point of the fluid, and at sufficiently high pressure to keep the fluid in liquid state. Upon passing through the nozzle, the fluid component of the mixture flashes or rapidly expands (if already in vapor state), forming a fluid jet which propels the issued material in the direction of the collection surface and spreads the remaining solidified material. In a preferred embodiment, the environment that the material is propelled into and/or the collection surface is maintained at a temperature near the boiling temperature of the fluid, so that condensation of the fluid is minimized. Advantageously, the environment is maintained at a temperature within about 40° C. of the boiling temperature of the fluid, or even within about 10° C. of the boiling temperature of the fluid. The temperature can be above or below the boiling temperature of the fluid.

A sheet product can also be formed by supplying a fluidized mixture of particles and a fluid to the spin pack. This can be accomplished by including a component in the mixture which will act as a binder in the product to hold the particles together in a sheet. Alternatively, the particles themselves can comprise a binder component to render the particles self-bonding. In either case, the particles collected on the collection surface are subsequently bonded by exposing the collected particles to an elevated temperature which softens or makes tacky the particles. The atmosphere surrounding the material being collected on the collection surface is maintained at a temperature sufficient to bond the collected material.

In one embodiment of the present invention, the material supplied to the nozzle is a fluidized mixture of at least two polymers having different melting or softening temperatures and the temperature of the atmosphere surrounding the material being collected on the collection surface is maintained at a temperature intermediate the melting or softening temperatures of two of the polymers, so that the lower melting or softening temperature polymer(s) soften and become tacky, thereby bonding the issued material into a coherent sheet.

In one embodiment of the invention, the fluidized mixture supplied to the nozzle is a polymeric solution comprising a polymer and a volatile spin agent. The spin agent flashes or vaporizes upon being issued through the spin orifice of the nozzle, forming a fluid jet of spin agent gas which propels the remaining component(s) of the mixture (polymer) from the nozzle. The fluid jet travels away from the nozzle at a speed of at least about 30 meters per second, advantageously at least about 61 meters per second. The flashing of the spin agent also causes the polymer to solidify into some form, such as plexifilamentary film-fibril strands, discrete fibrils, discrete particles or polymeric beads. The conditions required for flash spinning are known from U.S. Pat. No. 3,081,519 (Blades et al.), U.S. Pat. No. 3,169,899 (Steuber), U.S. Pat. No. 3,227,784 (Blades et al.), U.S. Pat. No. 3,851,023 (Brethauer et al.), the contents of which are hereby incorporated by reference.

Polymers which can be utilized in this embodiment of the invention include polyolefins, e.g., polyethylene, low density polyethylene, linear low density polyethylene, linear high density polyethylene, polypropylene, polybutylene, and copolymers of these.

Other polymers suitable for use in the invention include polyesters, including poly(ethylene terephthalate), poly(trimethylene terephthalate), poly(butylene terephthalate) and poly(1,4-cyclohexanedimethanol terephthalate); partially fluorinated polymers, including ethylene-tetrafluoroethylene, polyvinylidene fluoride and ECTFE, a copolymer of ethylene and chlorotrifluoroethylene; and polyketones such as E/CO, a copolymer of ethylene and carbon monoxide, and E/P/CO, a terpolymer of ethylene, polypropylene and carbon monoxide. Polymer blends can also be used in the invention, including blends of polyethylenes and polyesters, and blends of polyethylenes and partially fluorinated fluoropolymers. All of these polymers and polymer blends can form a solution with a spin agent which is then flash spun into plexifilamentary film-fibrils. Many polymer-spin agent combinations are possible, as disclosed in U.S. Pat. Nos. 5,009,820; 5,171,827; 5,192,468; 5,985,196; 6,096,421; 6,303,682; 6,319,970; 6,096,421; 5,925,442; 6,352,773; 5,874,036; 6,291,566; 6,153,134; 6,004,672; 5,039,460; 5,023,025; 5,043,109; 5,250,237; 6,162,379; 6,458,304; and 6,218,460, the contents of which are hereby incorporated by reference.

In one embodiment of the present invention, each nozzle includes a passage through which a polymeric solution comprising a polymer and a spin agent is supplied to a letdown orifice. The letdown orifice opens into a letdown chamber for holding the polymer solution at a letdown pressure lower than the cloud point of the solution to enter a region of two phase separation of polymer and spin agent. The letdown chamber leads to a spin orifice which opens to the outlet of the nozzle, which is defined by two opposing faces. The spin agent flashes upon issuing from the spin orifice, forming a web or plexifilamentary film-fibril strand. The outlet of the nozzle, also referred to herein as a "fan jet," is described in U.S. Pat. No. 5,788,993 (Bryner et al.), the contents of which are hereby incorporated by reference. The walls of the fan jet can be completely embedded within the face of the spin pack in order to more easily heat the walls. Advantageously the outlet has no discontinuous flow surfaces, e.g., no gaps, sharp corners or projections, between the exit of the spin orifice and exit of the fan jet, and the fan jet and spin orifice can be formed from one piece of material.

The fan jet causes the carrying jet to spread as it issues, thus also spreading the issued material. This results in an issued web having its mass distributed over the width of the carrying jet. In general, the greater the width, the more uniform the product when collected. There are, however, practical considerations limiting the desired width, such as space limitations, as would be apparent to the skilled artisan. The carrying jet spreads until the resisting tension forces in the polymeric film-fibril webs limit the spreading. In a spin pack having multiple, adjacent nozzles, the output web from each nozzle is overlapped with the web(s) from adjacent nozzle(s).

The temperature of the nozzle is advantageously maintained at a level at least as high as the melting temperature or softening point of the polymer being flash spun. The nozzle can be heated by any known method, including electrical resistance, heated fluid, steam or induction heating.

Figure 2:
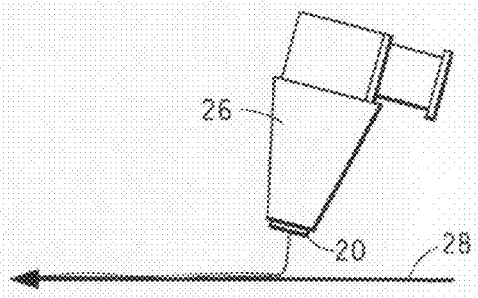
FIG. 2 is a schematic view of a flash spinning apparatus including the spin pack of FIG. 1 that is shown in the process of flash spinning a plexifilamentary web onto a moving belt.
Figure 3:
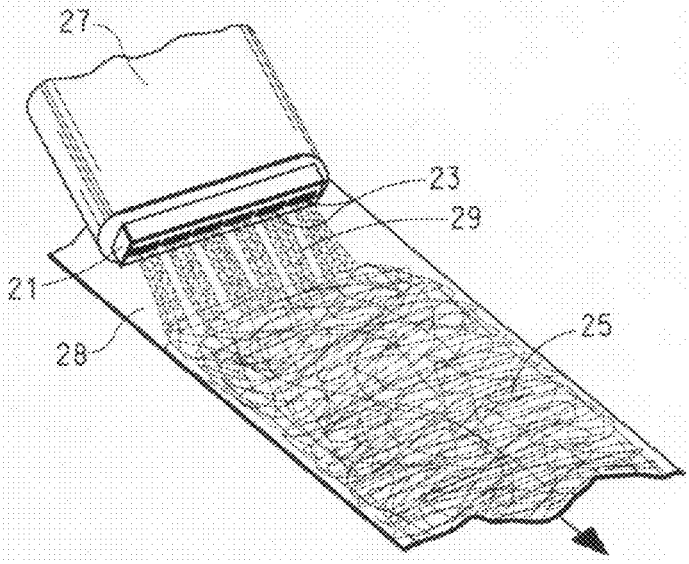
FIG. 3 is a schematic view of a flash spinning apparatus including an alternative spin pack that is shown in the process of flash spinning a plexifilamentary web onto a moving belt.
Figure 4:
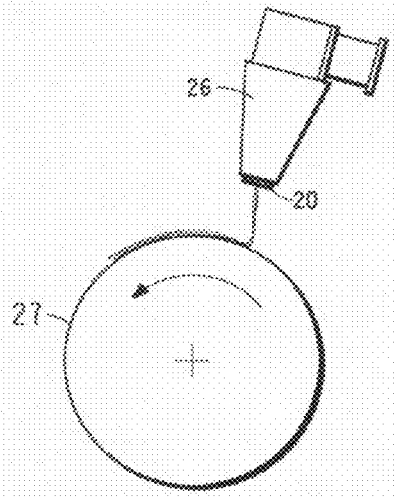
FIG. 4 is a schematic view of a flash spinning apparatus including a spin pack that is shown in the process of flash spinning a plexifilamentary web onto a rotating drum.

FIG. 1 illustrates a spin pack 20 for use in the process of the invention, including outlet 24 of the nozzle (not shown). FIG. 2 illustrates a flash spinning apparatus 26 employing spin pack 20 in the process of flash spinning a plexifilamentary web onto a moving collection belt 28. FIG. 3 illustrates a flash spinning apparatus 27 employing a spin pack 21 having multiple nozzles (not shown) and nozzle outlets 23 that is shown in the process of flash spinning a plexifilamentary web 29 onto a moving collection belt 28 to form a nonwoven sheet 25. Web 29 is issued from the spin pack with a fluid jet which expands upon issuing from the nozzle, and carries and propels the web at high speed away from the body of the spin pack. FIG. 4 illustrates a similar process in which flash spinning apparatus 26 employing spin pack 20 is shown in the process of flash spinning a plexifilamentary web onto a rotating collection drum 27. The surface of the drum can be the collection surface, or a separate collection surface can run over the rotating drum.

The fluid jet, formed by the flashing of the spin agent or the rapid expansion of the compressed vapor upon issuing from the nozzle, begins as laminar flow and decays into turbulent flow at some distance from the outlet of the nozzle. When a fibrous web is flash spun from the nozzle and carried by the fluid jet, the form of the web itself will be determined by the type of fluid flow of the jet. When the jet is in laminar flow, the web is much more evenly spread and distributed than when the jet is in turbulent flow. By collecting the flash spun web on a collection surface located a distance of between about 0.25 cm and about 13 cm from the nozzle, prior to the onset of large scale turbulent flow, a surprisingly uniform sheet product is achieved.

The fluid jet spreads the material in different directions as determined by the orientation of the fan jet. Preferably, the fan jet is oriented so that it spreads the material primarily in the cross direction (CD), i.e., perpendicular to the machine direction (MD). This results in an even distribution of material as it is issued. In one embodiment of the invention, it has been found that when the distance between the openings is approximately the width of an individual material-carrying fluid jet at the point at which the material is collected on the collection surface (i.e., the width of the material as it is collected) multiplied by a whole number, a very uniform product profile results.

When multiple nozzles are employed, a portion of the nozzles can be positioned such that the fan jets spread the material at an angle between about 20 and 40 degrees from the cross-machine direction, and a portion of the nozzles positioned such that the fan jets spread the material at the same angle in the opposite direction to the cross-machine direction. Having slotted outlets angled in opposite directions provides a resulting product having less directionality and more balanced properties.

The moving collection surface on which the issued material is collected can be porous so that vacuum can be applied to the issued material as it is being collected to assist the pinning and laydown of the material. The porous collection surface can be made from perforated metal sheet or rigid polymer. In one embodiment, the collection surface comprises a honeycomb material, which allows vacuum to be pulled on the collected material while providing sufficient rigidity not to deform as a result. The honeycomb can further have a layer of mesh covering it to collect the material.

The issued material can alternatively be collected on a substrate such as a woven or nonwoven fabric or a film moving on the collection surface. This can be especially useful when the material being collected is in the form of very fine particles. Alternatively, the collection surface can be a component of the product itself. For instance, a preformed woven or nonwoven sheet or film can be the collection surface and a low concentration solution can be issued onto the collection surface, forming a thin membrane. This can be useful for enhancing the surface properties of the preformed sheet or film, such as printability, adhesion, porosity level, and so on.

Various methods can be employed to secure or pin the material to the moving collection surface. According to one method, vacuum is applied to the opposite side of the collection surface with sufficient flow to cause the material to be pinned to the collection surface in sheet form. The amount of flow necessary will vary, depending on the porosity of the sheet and the shape of fibers.

As an alternative to pinning the issued material by vacuum, the material can be pinned to the collection surface by an electrostatic force of attraction between the material and the collection surface. This can be accomplished by creating either positive or negative ions into the gap between the spin pack and the collection surface while grounding the collection surface, so that the newly issued material picks up charged ions and thus the material becomes attracted to the collection surface. Whether to create positive or negative ions in the gap is determined by what is found to more efficiently pin the material being issued. For instance, it has been found that polyethylene plexifilamentary film-fibril material flash spun from a solution using a chlorofluorocarbon as the spin agent generally pins better when the material is positively charged than when it is negatively charged. When material is flash spun from a solution using a hydrocarbon as the spin agent, it generally pins better when it is negatively charged.

In order to create positive or negative ions in the gap between the spin pack and the collection surface, and thus to positively or negatively charge the material passing through the gap, one embodiment of the present invention employs a charge-inducing element installed on the spin pack. The charge-inducing element can comprise pin(s), brushes, wire(s) or other element, wherein the element is made from a conductive material such as metal or a synthetic polymer impregnated with carbon. A voltage is applied to the charge-inducing element such that an electric potential is generated in the charge-inducing element, creating a strong electric field in the vicinity of the charge-inducing element. The strong electric field will ionize the gas in the vicinity of the element, creating a corona. The amount of electrical current necessary to be generated in the charge-inducing element is that necessary to achieve good pinning of the material to the moving collection surface. The optimal amount of electrical current will vary depending on the specific material being processed, but the minimum is the level found to be necessary to sufficiently pin the material, and the maximum is the level just below the level at which arcing is observed between the charge-inducing element and the grounded collection surface. In the case of flash spinning a polyethylene plexifilamentary film-fibril material, a general guideline is that the material pins well when charged to approximately 8 p-coulombs per gram of film-fibril material. Voltage is applied to the charge-inducing element by connecting the charge-inducing element to a power supply. The farther from the collection surface the material is being issued, the higher the voltage must be to achieve equivalent electrostatic pinning force.

In one preferred embodiment, the charge-inducing elements used are conductive pins or brushes which are directed at the collection surface and are recessed in the spin pack surface so that they do not protrude into the gap between the spin pack and the collection surface. The charge-inducing elements are located subsequent to or "downstream" from the nozzles, from the vantage point of a point on the moving collection surface, so that material is issued from the nozzles and is subsequently charged by the charge-inducing elements.

When the charge-inducing elements are pins, they preferably comprise conductive metal. One or more pins can be used. When the charge-inducing elements are brushes, they can be any conductive material. As an alternative to pins or brushes, wire such as piano wire can be used as the charge-inducing element.

In an alternate embodiment of the present invention in which electrostatic force is also used to pin the material, conductive elements such as pins, brushes or wires installed on the spin pack are grounded, and the collection surface is connected to the power supply. The collection surface can be any conductive material that does not generate a back corona, a condition which has the effect of charging gas particles with the wrong (opposite from the desired) polarity, thus interfering with pinning.

If positive ions are desired so that the material is positively charged, then a negative voltage is applied to the collection surface. If negative ions are desired, then a positive voltage is applied to the collector.

In one embodiment of the present invention, a combination of vacuum pinning and electrostatic pinning is used to ensure that the material is efficiently pinned to the collection surface.

When the material being issued is polymeric, the gas that is passed through the moving collection surface during the process of the present invention can be heated so that a portion of the polymeric material bonds to itself at points. The gas can be supplied from plenums or hoods surrounding or adjacent to the spin pack.

In one embodiment of the invention in which the material being issued is a polymeric fibrous material, the temperature of the material as it is collected on the collection surface is sufficient to cause a portion of the polymeric fibrous material to soften or become tacky so that it bonds to itself and the surrounding material as it is collected. Preferably, a small portion of the polymer is caused to soften or become tacky. This can be accomplished either by heating the issued material before it is collected, or by collecting the material and immediately thereafter, passing heated gas therethrough.

Advantageously, the space surrounding the spin pack and collection surface is enclosed so that the temperature and pressure can be controlled. The enclosed space is herein referred to as the "spin cell." The spin cell can be heated according to any of a variety of well-known means. For example, the spin cell can be heated by a single means or a combination of means including blowing hot gas into the spin cell, steam pipes within the spin cell walls, electric resistance heating, and so on. The heating of the spin cell is one way according to the present invention to ensure good pinning of the polymeric fibrous material to the collection surface, since polymeric fibers become tacky above certain temperatures.

The heating of the spin cell can also enable the production of nonwoven products which are differentially bonded through the thickness thereof. This can be accomplished by forming a product from layers of polymers having different sensitivities to heat relative to each other. For instance, at least two polymers having different melting or softening temperatures can be issued from separate nozzles. The temperature of the spin cell would be controlled at a temperature greater than the melting or softening point of the lowest melting or softening temperature polymer, but lower than the melting or softening point of the highest melting or softening temperature polymer, thus the lowest melting or softening temperature polymer material would bond and the highest melting or softening temperature polymer material would remain unbonded.

If the material is polymeric and is heated sufficiently to self bond, as described above, the material may form a coherent sheet or membrane on the collection surface without the application of vacuum or electrostatic forces.

Another means of ensuring that the material is pinned to the collection surface in the flash spinning embodiment of the present invention is the introduction of a fogging fluid into the gap between the spin pack and the collection surface. In this embodiment, the fogging fluid comprising a liquid is issued from nozzle(s) which can be of the same type as the material-issuing nozzles. Such a nozzle is referred to herein as a "fogging jet." The fogging jets issue a mist of liquid droplets which assist the fibers in laying down on the collection surface. Preferably, there is one fogging jet for each material-issuing nozzle. The fogging jet is located adjacent the nozzle so that the mist issuing therefrom is introduced directly into the carrying jet issuing from the nozzle and some liquid droplets are entrained with the carrying jet and contact the web. The mist of liquid issuing from the fogging jets can also serve to provide added momentum to the issued material and reduce the level of drag that the issued material encounters before laying down on the collection surface.

When a polymer solution is flash spun according to the present invention, the concentration of the solution affects the polymer throughput per nozzle. The lower the polymer concentration, the lower the polymer throughput. The polymer throughput per nozzle can also be varied by changing the size of the nozzle orifice, as would be apparent to the skilled artisan.

The products made by the process of the invention include nonwoven sheets, films and discrete particles, and combinations thereof.

When a nonwoven sheet is formed, the process of the invention results in a surprisingly uniform product, in terms of basis weight uniformity. Products having a machine direction uniformity index of less than about 86.25 $(g/m^2)^{1/2}$ can be made, or less than about 47 $(g/m^2)^{1/2}$ and even less than about 23 $(g/m^2)^{1/2}$. The product is more uniform since each web layer is spread by the fan jet and collected prior to the onset of turbulence in the carrying jet.

The ratio of the tensile strength to basis weight is greater than about 15 $lb/in/oz/yd^2$ (0.78 $N/cm/g/m^2$). The resulting nonwoven product made by the process of the invention is a layered product having multiple web layers.

Test Methods

The following test methods are employed to determine various reported characteristics and properties herein. ASTM refers to the American Society of Testing Materials. ISO refers to the International Standards Organization. TAPPI refers to Technical Association of Pulp and Paper Industry.

Basis weight (BW) was determined by ASTM D-3776, which is hereby incorporated by reference and reported in $g/m^2$.

Tensile Strength was determined by ASTM D 1682, which is hereby incorporated by reference, with the following modifications. In the test a 2.54 cm by 20.32 cm (1 inch by 8 inch) sample was clamped at opposite ends of the sample. The clamps were attached 12.7 cm (5 inches) from each other on the sample. The sample was pulled steadily at a speed of 5.08 cm/min (2 inches/min) until the sample broke. The force at break was recorded in pounds/inch and converted to Newtons/cm as the breaking tensile strength.

Thickness (TH) was determined by ASTM D177-64, which is hereby incorporated by reference, and is reported in micrometers.

Elongation to Break (also referred to herein as "elongation") of a sheet is a measure of the amount a sheet stretches prior to breaking in a strip tensile test. A 2.54 cm (1 inch) wide sample is mounted in the clamps, set 12.7 cm (5 inches) apart, of a constant rate of extension tensile testing machine such as an Instron table model tester. A continuously increasing load is applied to the sample at a crosshead speed of 5.08 cm/min (2 inches/min) until failure. The measurement is given in percentage of stretch prior to failure. The test generally follows ASTM D 5035-95, which is hereby incorporated by reference.

Density of a sheet material was calculated by multiplying the basis weight of the sheet in $g/m^2$ by 10,000 to arrive at $g/cm^2$ and dividing by the thickness in cm, to arrive at density in $g/cm^3$.

Void Fraction of a polymeric sheet material is a measure of the porosity of the sheet material. Void fraction was calculated as 1 minus the density of the sheet as calculated herein divided by the theoretical density of the polymer, multiplied by 100, and is reported in %.

Frazier Permeability is a measure of air permeability of porous materials and is measured in cubic feet per minute per square foot, and subsequently converted and reported in units of liters/second/square meter. It measures the volume of air flow through a material at a differential pressure of 0.5 inches water. An orifice is mounted in a vacuum system to restrict flow of air through sample to a measurable amount. The size of the orifice depends on the porosity of the material. Frazier permeability, which is also referred to as Frazier porosity, is measured using a Sherman W. Frazier Co. dual manometer with calibrated orifice units in $ft^3/ft^2/min$.

Gurley Hill Porosity (GH) is a measure of the permeability of the sheet material for gaseous materials. In particular, it is a measure of how long it takes a volume of gas to pass through an area of material wherein a certain pressure gradient exists. Gurley-Hill porosity is measured in accordance with TAPPI T4600M-88, hereby incorporated by reference, using a Lorentzen & Wettre Model 121D Densometer. This test measures the time required for 100 cubic centimeters of air to be pushed through a 28.7 mm diameter sample (having an area of one square inch) under a pressure of approximately 1.21 kPa (4.9 inches) of water. The result is expressed in seconds that are sometimes referred to as Gurley Seconds.

Mullenburst Bursting Strength was determined by TAPPI T403-85, hereby incorporated by reference, and measured in psi, and subsequently converted and reported in $kN/m^2$.

Hydrostatic Head (HH) is a measure of the resistance of the sheet to penetration by liquid water under a static load. A 18 cm by 18 cm sample (7 inch by 7 inch) is mounted in a SDL 18 Shirley Hydrostatic head tester (manufactured by Shirley Developments Limited, Stockport, England). Water is pumped against one side of a 102.6 sq. cm. section of the sample at a rate of 60+/−3 cm per minute until three areas of the sample are penetrated by the water. The hydrostatic head is measured in inches, and converted to and reported in centimeters of water. The test generally follows ASTM D 583, hereby incorporated by reference, which was withdrawn from publication in November, 1976. A higher number indicates a product with greater resistance to liquid passage.

Moisture Vapor Transmission Rate (MVTR) is reported in $g/m^2/24$ hrs and was measured with a Lyssy Instrument using test method TAPPI T-523, hereby incorporated by reference.

Elmendorf Tear Strength is a measure of the force required to propagate a tear cut in a sheet. The average force required to continue a tongue-type tear in a sheet is determined by measuring the work done in tearing it through a fixed distance. The tester consists of a sector-shaped pendulum carrying a clamp that is in alignment with a fixed clamp when the pendulum is in the raised starting position, with maximum potential energy. The specimen is fastened in the clamps and the tear is started by a slit cut in the specimen between the clamps. The pendulum is released and the specimen is torn as the moving clamp moves away from the fixed clamp. Elmendorf tear strength is measured in Newtons in accordance with the following standard methods: TAPP1-T414 om-88 and ASTM D 1424, which are hereby incorporated by reference. The tear strength values reported for the examples below are each an average of at least twelve measurements made on the sheet.

Delamination Strength of a sheet sample is measured using a constant rate of extension tensile testing machine such as an Instron table model tester. A 1.0 in. (2.54 cm) by 8.0 in. (20.32 cm) sample is delaminated approximately 1.25 in. (3.18 cm) by inserting a pick into the cross-section of the sample to initiate a separation and delamination by hand. The delaminated sample faces are mounted in the clamps of the tester which are set 1.0 in. (2.54 cm) apart. The tester is started and run at a cross-head speed of 5.0 in./min. (12.7 cm/min.). The computer starts picking up force readings after the slack is removed in about 0.5 in. of crosshead travel. The sample is delaminated for about 6 in. (15.24 cm) during which 3000 force readings are taken and averaged. The average delamination strength is the average force divided by the sample width and is expressed in units of N/cm. The test generally follows the method of ASTM D 2724-87, which is hereby incorporated by reference. The delamination strength values reported for the examples below are each based on an average of at least twelve measurements made on the sheet.

Opacity is measured according to TAPPI T-425 om-91, which is hereby incorporated by reference. The opacity is the reflectance from a single sheet against a black background compared to the reflectance from a white background standard and is expressed as a percent. The opacity values reported for the examples below are each based on an average of at least six measurements made on the sheet.

Spencer Puncture Resistance is measured according to ASTM D 3420, which is hereby incorporated by reference, and measures the energy required to puncture the sample. The Spencer Puncture is measured in $in\text{-}lb/in^2$ and converted to $cm\text{-}N/cm^2$. The apparatus, falling pendulum type tester modified with Spencer impact attachment model 60-64, is made by Thwing-Albert Instrument Co.

Machine Direction Uniformity Index (MD UI) of a sheet is calculated according to the following procedure. A beta thickness and basis weight gauge (available from Honeywell-Measurex, Cupertino, Calif.) scans the sheet and takes a basis weight measurement every 0.2 inches across the sheet in the cross direction (CD). The sheet then advances 0.425 inches in the machine direction (MD) and the gauge takes another row of basis weight measurements in the CD. In this way, the entire sheet is scanned, and the basis weight data is electronically stored in a tabular format. The rows and columns of the basis weight measurements in the table correspond to CD and MD "lanes" of basis weight measurements, respectively.

Then each data point in column 1 is averaged with its adjacent data point in column 2; each data point in column 3 is averaged with its adjacent data point in column 4; and so on. Effectively, this cuts the number of MD lanes (columns) in half and simulates a spacing of 0.4 inch between MD lanes instead of 0.2 inch. In order to calculate the uniformity index (UI) in the machine direction ("MD UI"), the UI is calculated for each column of the averaged data in the MD. The UI for each column of data is calculated by first calculating the standard deviation of the basis weight and the mean basis weight for that column. The UI for the column is equal to the standard deviation of the basis weight divided by the square root of the mean basis weight, multiplied by 100. Finally, to calculate the overall machine direction uniformity index (MD UI) of the sheet, all of the UI's of each column are averaged to give one uniformity index. Uniformity Index is reported here in (grams per square meter)$^{1/2}$.

COMPARATIVE EXAMPLE A

A solution of 12% Mat 6 high density polyethylene (obtained from Equistar Chemicals LP) in a spin agent of Freon® 11 (obtained from Palmer Supply Company) was fed to a spinning beam or a rectangular block containing passages distributing the dispersion to a set of 8 nozzles comprising spinning orifices opening to fan jets. The solution was flash spun through the nozzles in the form of plexifilamentary web onto a collection substrate of unbonded Tyvek® spunbond polyolefin (style 1056 available from E. I. du Pont de Nemours & Company, Inc.). The solution was flash spun at a temperature of 180° C. and a let-down pressure of 850 psig (5.9 MPa). The collection substrate and the collected material were conveyed by a moving porous collection belt. The distance between the outlet of the nozzles and the collection belt was 6 inches (15 cm), at which distance large scale turbulent flow of the fluid jets occurred.

The passages within the beam led to let down orifices having a diameter of 0.025 inch (0.064 cm) and a length of 0.038 inch (0.096 cm) which opened to let down chambers having a diameter of 0.480 inch (1.2 cm) and a length of 3.0 inch (7.6 cm). Each let-down chamber led to a spin orifice having a diameter of 0.025 inch (0.064 cm) and a length of 0.080 inch (0.20 cm). Each spin orifice opened to a fan jet. The flow rate was approximately 20 pph (9.1 kg/hr) per orifice, or 160 pph (72 kg/hr) total. Each fan jet comprised two concave walls the midpoints of which were in line with the spin orifice. The walls of the fan jet were 0.020 inch (0.05 cm) apart at the ends of the walls, and 0.25 inch (0.64 cm) apart at the midpoint of the walls. The walls of the fan jets had a concave curvature having a radius of 2.25 inch (5.72 cm).

A row of electrostatic needles was located on the upstream and downstream sides of the spinning nozzles at a distance of 0.25 inch (0.64 cm) from the beam. The needles were spaced approximately 0.75 inch (1.9 cm). apart. The needles were electrically charged and brought to a voltage of 40 kV to 70 kV. The collection belt was grounded.

The process ran well for 30 seconds before the web began to hang up on the needles of the electrostatic wand downstream of the nozzles.

COMPARATIVE EXAMPLE B

The solution used in Comparative Example A was fed to an 8-nozzle beam as in Comparative Example A. The conditions and hardware used were the same with the exception that the electrostatic needles were on the upstream side of the nozzles only.

The process ran for 3 minutes. The product laydown was observed to be acceptable.

COMPARATIVE EXAMPLE C

The same process conditions and hardware were used as in Comparative Example B.

The process ran for 7.25 hours. The individual webs formed appeared acceptable, although some of the webs tended to clump together to form "ropes" in the product, a result of the large scale turbulent flow of the fluid jets.

EXAMPLE 1

A dispersion of 0.5% Mat 8 high density polyethylene (obtained from Equistar Chemicals LP) and 1% cellulose (BH600-20 Alpha-cel obtained from International Fibers Corporation) in a spin agent of Freon® 11 (obtained from Palmer Supply Company) was fed to a spinning beam containing passages distributing the dispersion to a set of 4 nozzles comprising spinning orifices opening to fan jets. Each nozzle comprised a let down orifice having a diameter of 0.025 inch (0.064 cm) and a length of 0.080 inch (0.20 cm) which opened to a let down chamber. The let-down chamber led to a spin orifice having a diameter of 0.025 inch (0.064 cm) and a length of 0.080 inch (0.20 cm). The spin orifice opened to a fan jet comprising two concave walls 0.04 inch (0.1 cm) apart at the midpoint of the walls and tapering to 0.03 inch (0.08 cm) apart at the ends. The walls were 1.6 inch (4.1 cm) in length. The concave curvature of the walls had a radius of 1.5 inch (3.8 cm).

The dispersion was flash spun through the fan jets onto a collection substrate of unbonded Tyvek® spunbond polyolefin (available from E. I. du Pont de Nemours & Company, Inc.). The dispersion was flash spun at a temperature of between 176° C. and 179° C. and a letdown pressure of between 1400 psig (9.6 MPa) and 1500 psig (10 MPa). The Tyvek® collection substrate and the collected material were conveyed by a moving porous collection belt. The distance between the outlet of the nozzles and the collection belt was 3 inches (7.6 cm).

Vacuum was applied to hold the Tyvek® to the collection belt.

A layer of HDPE and cellulose having a basis weight of 0.75 oz/yd$^2$ (25 g/m$^2$) was deposited onto the surface of the Tyvek® substrate. The polymeric particles of the HDPE were sufficiently tacky to adhere the cellulose to the Tyvek® without any other apparent pinning force, so that the HDPE polymer acted as a binder adhering the cellulose particles to each other as well as to the Tyvek® substrate.

Subsequent ink jet print trials showed improved printing characteristics attributed to the layer of HDPE and cellulose. The printability of the collection substrate having the layer of HDPE and cellulose deposited thereon was compared to that of the opposite side of the collection substrate without such a layer of HDPE and cellulose (unbonded Tyvek® spunbond polyolefin). Both the coated collection substrate of Example 1 and the opposite (uncoated) control side of the collection substrate were fed through an Hewlett-Packard 870 CXi ink jet printer (available from Hewlett-Packard Development Company, LP), first using a black ink cartridge (HP51645a from Hewlett-Packard Development Company, LP) and then using a colored ink cartridge (HP51641a available from Hewlett-Packard Development Company, LP). One design was printed in the colors green, yellow, red, blue, and black. The HDPE/cellulose coated side of the sample was printed first. Each of the 5 different colored inks (including black) appeared to dry immediately. After 20 minutes, the opposite side of the sample was printed with the same design in the 5 different colored inks. The colors appeared to dry immediately. After 2 hours, the black ink was still not dry, and could be easily smeared. Reduced feathering was observed in the ink on the printed surface of the HDPE/cellulose coated sample and an overall sharper printed image was achieved vs. the control substrate.

EXAMPLE 2

A polymeric solution of 11% Mat 8 HDPE (obtained from Equistar Chemicals LP) in Freon® 11 (obtained from Palmer Supply Company) was flash spun through a nozzle at a let-down pressure of 1200 psig (8.3 MPa) and a spin temperature of 190° C. to 193° C. The nozzle comprised a let-down orifice leading to a let-down chamber which in turn led to a spin orifice opening to a fan jet. The let-down orifice had a diameter of 0.025 inch (0.064 cm) and a length of 0.038 inch (0.096 cm). The let-down orifice opened to a let-down chamber, leading to a spin orifice having a diameter of 0.025 inch (0.064 cm) and a length of 0.080 inch (0.20 cm). The spin orifice opened to a fan jet. The fan jet comprised two walls having a concave curvature towards each other, such that the distance between the walls is greatest, 0.04 inch (0.1 cm), between the midpoints of the walls, and smallest, 0.03 inch (0.08 cm), at the ends of the walls. The flash spun web was deposited onto a collection substrate of Reemay® spunbond polyester (available from BBA Nonwovens). The collection substrate and the collected material were conveyed by a moving porous collection belt. The distance between the outlet of the nozzles and the collection belt was 3 inches (7.6 cm).

Voltage was applied to the collection belt by holding constant a current in the conductive belt of 200 μA. The belt speed was varied. The voltage varied from −30 to −70 kV with more voltage required for the slower belt speed (higher basis weight).

The machine direction uniformity index (MD UI) of the resulting product is given in Table 1.

EXAMPLE 3

A polymeric solution of 11% Mat 8 HDPE (obtained from Equistar Chemicals LP) in Freon® 11 (obtained from Palmer Supply Company) was flash spun through the nozzle as described in Example 2 at a letdown pressure of 1200 psig (8.3 MPa) and a spin temperature of 190° C. to 193° C. The flash spun web was deposited onto a collection substrate of Reemay® spunbond polyester (available from BBA Nonwovens). The distance between the outlet of the nozzles and the collection belt was 3 inches (7.6 cm).

Voltage was applied to the collection belt as in Example 2.

Vacuum was applied to the collection belt by means of a vacuum blower in communication with the collection belt to pin the flash spun web at a vacuum pressure of 14-17 psig (96-117 kPa). The vacuum blower ran at a speed of 2000 rpm.

The machine direction uniformity index (MD UI) of the resulting product is given in Table 1.

EXAMPLE 4

A polymeric solution of 11% Mat 8 HDPE (obtained from Equistar Chemicals LP) in Freon® 11 (obtained from Palmer Supply Company) was flash spun through the nozzle as described in Example 2 at a letdown pressure of 1200-1300 psig (8.3-9.0 MPa) and a spin temperature of 190° C.

The flash spun web was deposited onto a collection substrate of Reemay® spunbond polyester (available from BBA Nonwovens). The distance between the outlet of the nozzles and the collection belt was 3 inches (7.6 cm).

Vacuum was applied to the collection belt as in Example 3.

The machine direction uniformity index (MD UI) of the resulting product is given in Table 1.

EXAMPLE 5

A polymeric solution of 11% Mat 8 HDPE (obtained from Equistar Chemicals LP) in Freon® 11 (obtained from Palmer Supply Company) was flash spun through the nozzle as described in Example 2 at a letdown pressure of 1200 psig (8.3 MPa) and a spin temperature of 190° C. to 192° C.

The flash spun web was deposited onto a collection substrate of Reemay® spunbond polyester (available from BBA Nonwovens). The distance between the outlet of the nozzles and the collection belt was 3 inches (7.6 cm).

Voltage was applied to a needle array that was isolated from both the collection belt and the nozzle. Ions flowed from the electrostatic needles to the nozzle, consequently, web issuing from the nozzles picked up a charge passing through the ion field. The current through the electrostatic needles was held constant at 200 μA. The voltage varied from +30 to +50 kV.

The machine direction uniformity index (MD UI) of the resulting product is given in Table 1.

EXAMPLE 6

A polymeric solution of 11% Mat 8 HDPE (obtained from Equistar Chemicals LP) in Freon® 11 (obtained from Palmer Supply Company) was flash spun through the nozzle as described in Example 2 at a letdown pressure of 1200 psig (8.3 MPa) and a spin temperature of 190° C. to 192° C.

The flash spun web was deposited onto a collection substrate of Reemay® spunbond polyester (available from BBA Nonwovens). The distance between the outlet of the nozzles and the collection belt was 3 inches (7.6 cm).

Voltage was applied to a needle array that was isolated from both the collection belt and the nozzle, as in Example 5.

Vacuum was applied to the collection belt as in Example 3.

The machine direction uniformity index (MD UI) of the resulting product is given in Table 1.

EXAMPLE 7

A polymeric solution of 11% Mat 8 HDPE (obtained from Equistar Chemicals LP) in Freon® 12 (obtained from Palmer Supply Company) was flash spun through the nozzle as described in Example 2 at a letdown pressure of 1200-1400 psig (8.3-9.6 MPa) and a spin temperature of 189° C. to 195° C.

The flash spun web was deposited onto a collection substrate of Reemay® spunbond polyester (available from BBA Nonwovens). The distance between the outlet of the nozzles and the collection belt was 3 inches (7.6 cm).

Vacuum was applied to the collection belt as in Example 3.

The machine direction uniformity index (MD UI) of the resulting product is given in Table 1.

TABLE 1

| Example No. | Belt Speed m/min (yd/min) | MD UI $(g/m^2)^{1/2}$ $((oz/yd^2)^{1/2})$ |
|---|---|---|
| 2 | 91 (100) | 11.7 (68.1) |
| | 180 (200) | 11.1 (64.6) |
| 3 | 91 (100) | 12.4 (72.3) |
| | 180 (200) | 11.8 (68.7) |
| | 270 (300) | 12.5 (72.8) |
| 4 | 91 (100) | 14.8 (86.1) |
| | 180 (200) | 15.0 (87.3) |
| | 270 (300) | 13.4 (78.0) |
| 5 | 91 (100) | 11.2 (65.2) |
| | 180 (200) | 11.6 (67.5) |
| | 270 (300) | 12.4 (72.3) |
| 6 | 91 (100) | 14.3 (83.3) |
| | 180 (200) | 23.6 (137) |
| | 270 (300) | 16.2 (94.3) |

TABLE 1-continued

| Example No. | Belt Speed m/min (yd/min) | MD UI $(g/m^2)^{1/2}$ $((oz/yd^2)^{1/2})$ |
|---|---|---|
| 7 | 91 (100) | 35.3 (206) |
| | 180 (200) | 29.8 (174) |
| | 270 (300) | 14.3 (83.3) |

EXAMPLE 8

A solution of 16% Mat 6 high density polyethylene (obtained from Equistar Chemicals LP) in a spin agent of 85% methylene chloride (obtained from Industrial Chemical Inc.) and 15% Vertrel® XF (obtained from E. I. du Pont de Nemours and Company) was fed to a spinning block containing a passage to a nozzle comprising a spinning orifice opening to a fan jet. The fan jet comprised two concave walls, the midpoints of which were in line with the spin orifice. The walls of the fan jet were 0.010 inch (0.025 cm) apart at the ends of the walls, and 0.08 inch (0.20 cm) apart at the midpoint of the walls. The fan jet was 0.66 inch (1.68 cm) in length. The exit angle of the spin orifice was 60°.

The solution was flash spun through the nozzles in the form of plexifilamentary web onto a collection substrate of Reemay® spunbond polyester (available from BBA Nonwovens). The solution was flash spun at a temperature of 210° C. and a let-down pressure of 762 psig (5.25 MPa). The distance between the outlet of the nozzles and the collection belt was 1 inch (2.54 cm).

The passages within the beam led to let down orifices having a diameter of 0.025 inch (0.064 cm) and a length of 0.032 inch (0.081 cm) which opened to let down chambers having a diameter of 0.480 inch (1.2 cm) and a length of 3.0 inch (7.6 cm). The let-down chambers led to spin orifices having a diameter of 0.025 inch (0.064 cm) and a length of 0.080 inch (0.20 cm). The flow rate was approximately 24 pounds per hour (10.9 kg/hr).

The Reemay® collection substrate was moving at a rate of 60 yd/min (55 mpm), which resulted in a collected solution basis weight of 2.2 $oz/yd^2$ (75 $g/m^2$). The solution was spun onto the collection substrate with no vacuum pinning force or electrostatic pinning force. The issued web was adequately pinned to the collection substrate.

We claim:

1. A flash spinning process comprising the steps of:

flash spinning by supplying a fluidized mixture having at least two components to at least one nozzle comprising an orifice opening into a slotted fan jet outlet; issuing the fluidized mixture from the slotted fan jet outlet to form an issued material; vaporizing or expanding at least one component of the issued material to form a fluid jet; transporting the remaining component(s) of the issued material away from the nozzle with the fluid jet; and collecting the remaining component(s) of the issued material prior to the onset of large scale, turbulent flow on a moving collection surface located at a distance of about 0.25 cm to about 13 cm from the nozzle wherein one component of the fluidized mixture comprises a spin agent, further comprising supplying the fluidized mixture to the nozzle at a temperature greater than the boiling temperature of the spin agent at a pressure sufficient to keep the spin agent in liquid state, and issuing the fluidized mixture into an environment at a temperature within about 40° C. of the boiling temperature of the spin agent, such that the spin agent vaporizes and a solidified second component is issued from the nozzle.

2. The process of claim 1, wherein the fluidized mixture is issued into an environment at a temperature within about 10° C. of the boiling temperature of the spin agent.

3. The process of claim 1, wherein the fluidized mixture comprises a spin agent and the fluidized mixture is issued at a temperature above the boiling temperature of the spin agent.

4. The process of claim 1, wherein the speed of the issuing material is at least about 30 meters per second.

5. A process comprising flash spinning a polymer solution through a nozzle having a spin orifice opening into a slotted fan jet outlet to form a fluid jet containing plexifilamentary film-fibril strand material and collecting the plexifilamentary film-fibril strand material prior to the onset of large scale, turbulent flow on a moving collection surface located a distance of between about 0.25 cm and about 13 cm from the nozzle.

6. The process of claim 1 or claim 5, wherein the moving collection surface is located a distance of between about 1.3 cm and about 3.8 cm from the nozzle.

7. The process of claim 1 or claim 5, wherein the moving collection surface is a moving belt.

8. The process of claim 1 or claim 5, wherein the moving collection surface is a rotating drum.

9. The process of claim 5, wherein the polymer is polyolefin.

10. The process of claim 1, further comprising heating the collected material to a temperature sufficient to bond the collected material.

11. The process of claim 1, wherein the fluidized mixture comprises a polymer, further comprising passing hot gas through the collected material at a temperature sufficient to bond the collected material.

12. The process of claim 1, wherein the fluidized mixture comprises two polymers having different melting or softening temperatures and further comprising maintaining the temperature of the collected material at a temperature intermediate the melting or softening temperatures of the two polymers.

13. The process of claim 1, wherein the fluidized mixture comprises a mixture of pulp and fluid.

14. The process of claim 1, wherein the fluidized mixture comprises a mixture of particles and fluid.

15. The process of claim 1, wherein the fluidized mixture further comprises a binder component.

16. The process of claim 5, wherein the slotted fan jet outlet spreads the material primarily in the cross direction.

17. The process of claim 1, further comprising applying vacuum through the moving collection surface.

18. The process of claim 1 or claim 5, further comprising creating an electrical potential between the issued material and the moving collection surface.

19. The process of claim 18, further comprising applying a voltage to the moving collection surface and grounding the nozzle.

20. The process of claim 18, further comprising applying a voltage to the nozzle and grounding the moving collection surface.

21. The process of claim 1 or claim 5, further comprising issuing a liquid mist between the nozzle and the collection surface from at least one fogging jet nozzle.

* * * * *